United States Patent [19]

Shiraishi et al.

[11] 4,178,132

[45] Dec. 11, 1979

[54] METHOD AND DEVICE FOR CONTROLLING THE NUMBER OF PUMPS TO BE OPERATED

[75] Inventors: Atsuko Shiraishi, Kokubunji; Makoto Shioya, Tokyo, both of Japan

[73] Assignee: Hitachi, Ltd., Japan

[21] Appl. No.: 751,988

[22] Filed: Dec. 20, 1976

[30] Foreign Application Priority Data

Dec. 24, 1975 [JP] Japan ..... 50/153315

[51] Int. Cl.[2] ..... F04B 49/06

[52] U.S. Cl. ..... 417/5; 417/53

[58] Field of Search ..... 417/2–12, 417/53

[56] References Cited

U.S. PATENT DOCUMENTS

| | | | |
|---|---|---|---|
| 2,222,595 | 11/1940 | Regester | 417/5 |
| 2,458,683 | 1/1949 | Cowherd et al. | 417/7 |
| 3,005,411 | 10/1961 | Metz | 417/7 |
| 3,744,932 | 7/1973 | Prevett | 417/7 |
| 3,817,658 | 6/1974 | Murase | 417/2 |
| 3,966,358 | 6/1976 | Heimes | 417/12 |
| 4,108,574 | 8/1978 | Bartley et al. | 417/22 |

FOREIGN PATENT DOCUMENTS

| | | | |
|---|---|---|---|
| 672708 | 10/1963 | Canada | 417/2 |
| 2200487 | 7/1973 | Fed. Rep. of Germany | 417/2 |
| 2421571 | 11/1974 | Fed. Rep. of Germany | 417/2 |
| 1084886 | 9/1967 | United Kingdom | 417/12 |
| 263315 | 10/1970 | U.S.S.R. | 417/5 |

*Primary Examiner*—William L. Freeh

*Attorney, Agent, or Firm*—Craig and Antonelli

[57] ABSTRACT

In a system for controlling the flow rate of water supplied in a multi-pump water supply system which includes a pond or reservoir for the water, a first characteristic curve representing the cumulative values of predicted load flow rates over a period of time and a second characteristic curve representing the sum of the cumulative values and the capacity of the pond are generated. Operation routes restricted as to the number of pump change-over operations are then sought so that the routes pass through the region between the first and second characteristic curves and the gradient of the portion of each operation route is changed when the operation route crosses with the first or second characteristic curve. Among the operation routes sought, there is selected an optimum operation route which has the most suitable evaluation function from the point of view of energy consumption and efficiency. The pumps are then controlled in number in response to the selected operation route.

20 Claims, 9 Drawing Figures

METHOD AND DEVICE FOR CONTROLLING THE NUMBER OF PUMPS TO BE OPERATED

BACKGROUND OF THE INVENTION

The present invention relates to a method and a device for controlling the number of pumps to be operated at any given time in a multi-pump pumping system, such as a water supply system, a sewer system, an irrigation system, a drain system, or the like.

In an irrigation system for supplying irrigation water to farms, for example, after the irrigation water is pumped-up into a pond by one or more pumps in the system, it is supplied to various outlets to the farms. In such system, it is generally desirable to regulate the pumping-up flow rate by suitable control of the pumps in the system to provide maximum economy of operation with a simple construction. There is hitherto well known a multi-pump system which controls the pumping-up flow rate by changing the number of pumps which are operated at any given time in response to the detected water level of the pond. That is, in this known system, the operation of the respective pumps is controlled in response to whether or not the actual water level of the pond is between the upper limits and the lower limits of the water levels which are capable of being maintained by the respective pumps.

Furthermore, there is hitherto known a program control system which changes the number of the pumps being operated in response to a predicted load flow rate. However, these prior art systems cannot provide the degree of optimum pump operation which makes it possible to control the pumping-up flow rate with the small number of switching or change-over operations of the pumps necessary to achieve low energy consumption in the system.

SUMMARY OF THE INVENTION

An object of the present invention is to provide a method and a device for controlling the number of pumps to be operated at any given time with a relatively small number of the change-over operations of the pumps to thereby provide low energy consumption.

According to the present invention, a first characteristic line representing the cumulative values of predicted load flow rates with time and a second characteristic line representing values corresponding to the sum of the cumulative values and the capacity of the pond are determined. Operation routes restricted in the number of pump change-over operations are then formulated so that the routes pass through the region between these first and second lines, and the gradient (pump flow rate) of the portion of the operation route is charged when the route reaches or crosses either of the first and second lines. Among the operation routes sought, there is selected an optimum operation route which makes the evaluation function most suitable. The pumps are then controlled in number corresponding to the selected operation route to provide the proper flow rate at any given time.

DESCRIPTION OF THE PREFERRED EMBODIMENTS

Figure 1:
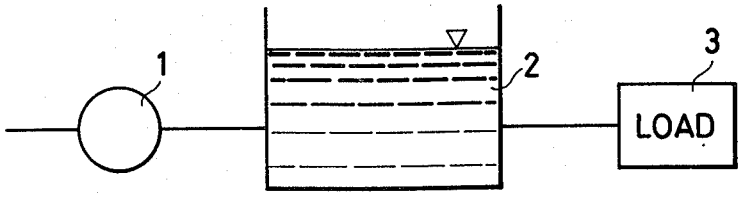
FIG. 1 is a schematic diagram showing a model of a water system suitable to the present invention.

FIG. 1 shows a model of a water system of the type for which the present invention has been designed. In FIG. 1 the water is pumped-up under the control of a pump system 1 including a plurality of pumps and is charged in a pond 2. The charged water is supplied to a load 3 in the form of a water supply system, a sewer system, an agricultural irrigation system, or the like.

Figure 2:
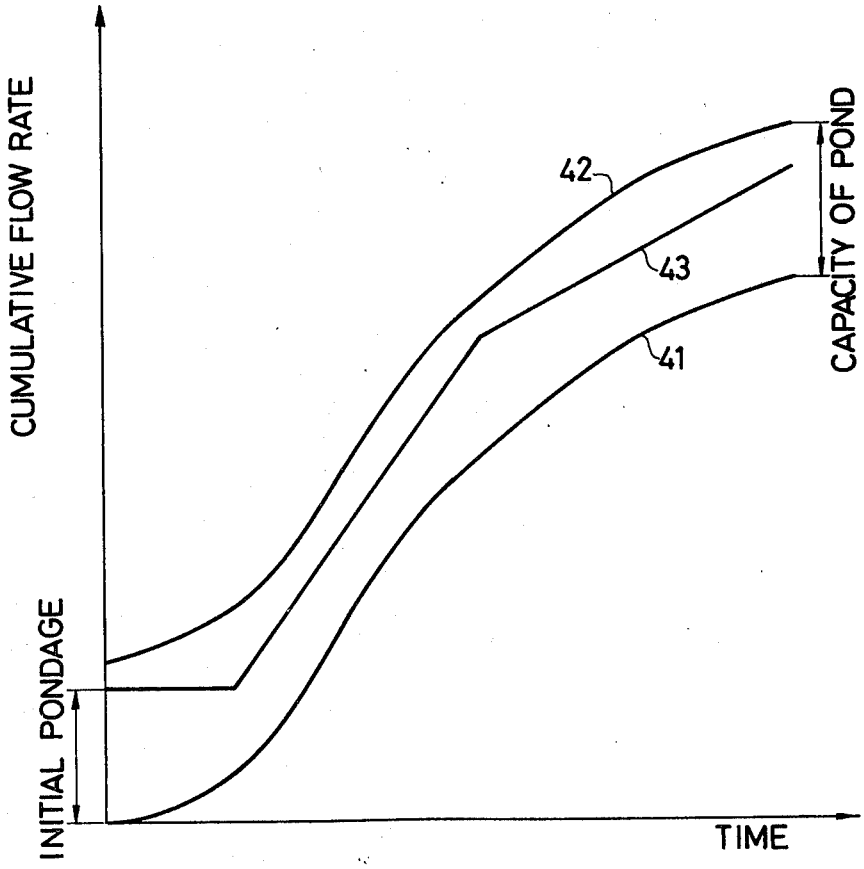
FIGS. 2 and 3 are diagrams showing characteristics under the principle of the present invention.
Figure 3:
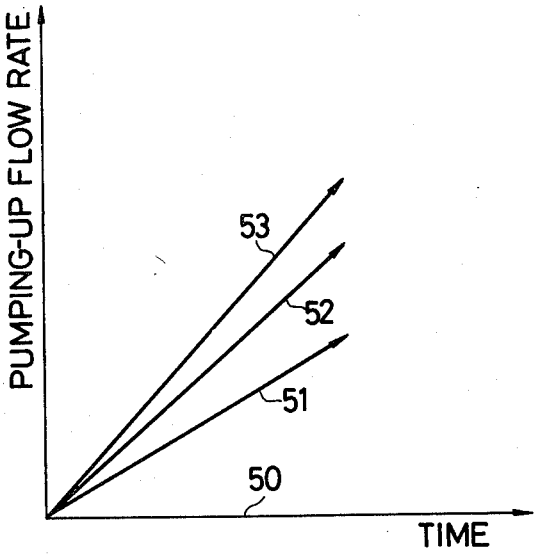

FIGS. 2 and 3 show characteristics which aid in explaining the principle of the present invention.

In FIG. 2 where the abscissa represents elapsed time and the ordinate represents cumulative flow rate, numeral 41 denotes a curved line representing cumulative values of the predicted load flow rates, numeral 42 denotes a curved line representing the predicted cumulative values increased by the capacity of the pond and numeral 43 denotes a curved line representing the cumulative values of the pumped-up flow rates, that is, a pump operation route. The curved line 43 is established so that it is always within the region between the curved lines 41 and 42. If the curved line 43 falls below the curved line 41, it is impossible to supply a sufficient flow rate to the load. On the other hand, if the curved line 43 rises over the curved line 42, the water overflows out of the pond.

The following conditions must be satisfied in order to achieve optimum operation of the pumps:

(b 1) to minimize the energy consumption which reduces the cost of pump operation;

(2) to minimize the number of change-over operations of the pumps which serves to lengthen the life time of the pumps.

As shown in FIG. 3, the gradient of the curved line 43 is determined by the pumping-up flow rate corresponding to the respective number of operated pumps. In FIG. 3 numerals 50, 51, 52, and 53 denote the gradients of the operation route 43 in a case where the number of the operated pumps is 0, 1, 2, and 3, respectively.

Since the number of the pumps to be operated is changed whenever the gradient of the operation route 43 is changed, it is desirable from an economic point of view to minimize the number of changing points of the gradient thereof, that is, the number of pump change-over operations occurring along the route.

According to the present invention, there is obtained an optimum pump operation route 43 which is within the region between the curved lines 41 and 42 and in which the number of the changing points of the gradient is remarkably reduced.

Figure 4:
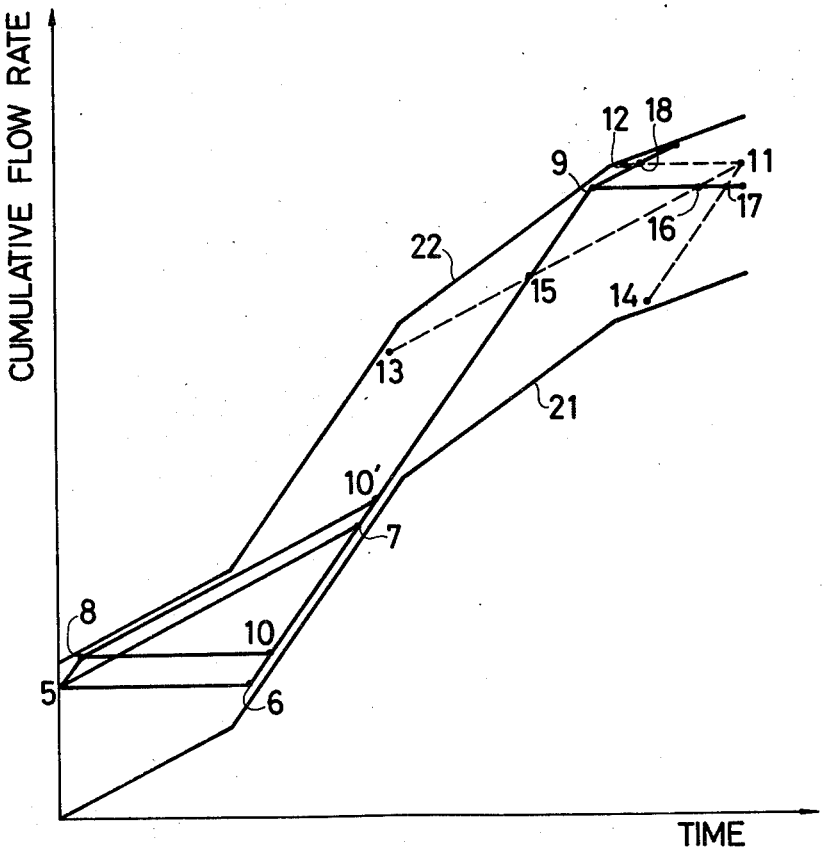
FIG. 4 is a diagram showing an example of pump operation routes according to the present invention.

A method for obtaining the optimum pump operation route will now be explained. At first, as shown in FIG. 4, the curved lines 41 and 42 shown in FIG. 2 are approximated by polygonal lines 21 and 22, respectively.

The curved lines 41 and 42 may be approximated by simplified curved lines. The lines 21 and 22 may be adjusted in accordance with the following restriction conditions:

(1) to always maintain the water level of the pond at more than a predetermined level, the line 21 is moved up;

(2) to allow for error in the predicted load flow rate, the distance between the lines 21 and 22 is narrowed.

Figure 5:
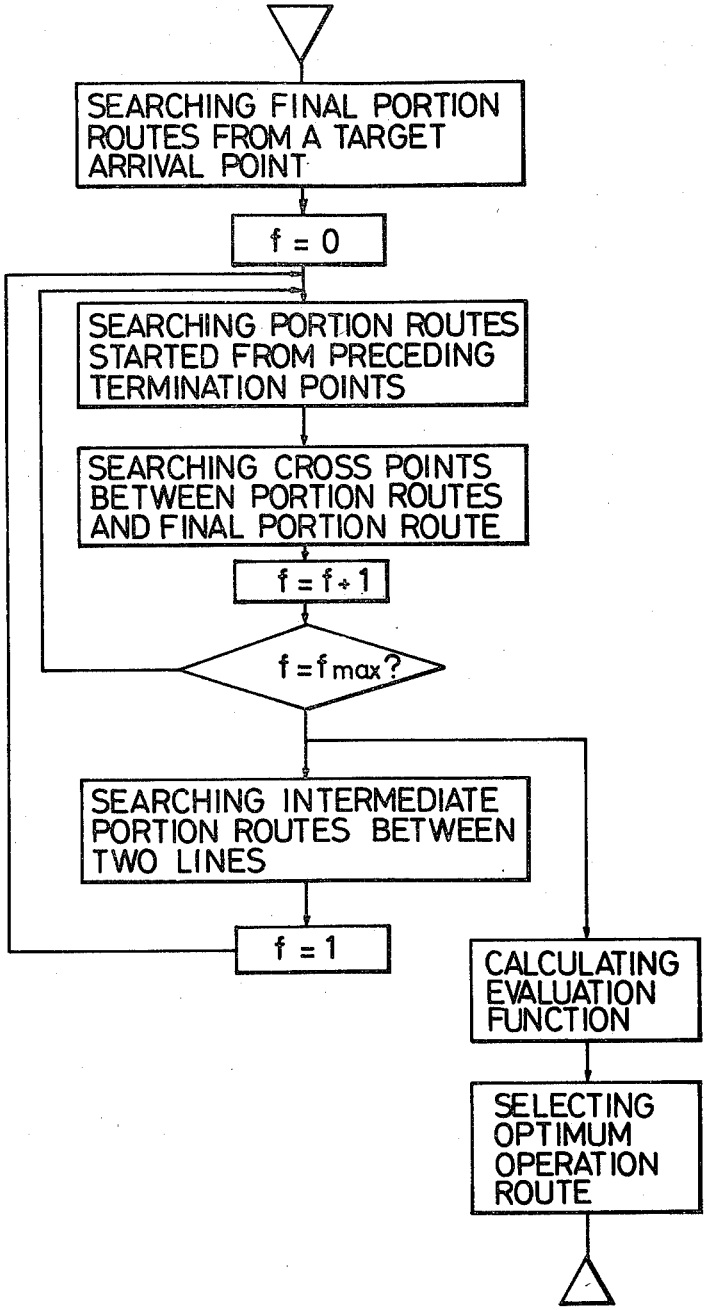
FIG. 5 is a flow chart for explaining an embodiment of a method according to the present invention.

The various pump operation routes which pass through the region between the lines 21 and 22 at the various gradients provided by the pumps, as indicated in FIG. 3, are determined as shown in FIGS. 4 and 5. The possible linear routes from a target arrival point 11, that is, the target pondages to be ultimately reached at a final time, are first determined in the reverse direction for various pump flow rates. These final route portions are represented by, for example, direct lines 11–12, 11–13, and 11–14, as shown in FIG. 4. Linear route portions from a starting point 5, that is, from the point of the initial pondage at an initial time, are determined in a corresponding manner for the respective number of the operated pumps, and these route portions are terminated when they reach or cross the lines 21 and 22. In the alternative, the routes may be terminated just before they cross the lines 21 and 22, as seen in FIG. 4.

The initial route portions are represented by, for example, direct lines 5–6, 5–7, and 5–8 as shown in FIG. 4. Furthermore, the thus-obtained initial route portions may be neglected when the period of the initial route portion is less than a predetermined period. The reason is that it would be useless to change-over the number of the operated pumps before a sufficient time has elapsed to achieve a stationary operating condition.

Next, it is determined whether or not any initial route portion crosses with one or more final route portions. If any initial route portion crosses with any final route portion, a route constituted by the combination of these route portions crossing each other is a completed operation route.

Succeeding route portions beginning from the respective termination points of the initial route portions are then determined so that the succeeding route portions are terminated when they reach or cross with the lines 21 and 22. These succeeding route portions are represented by, for example, direct lines 6–9, 7–9, 8–10, and 8–10', as shown in FIG. 4. It is then determined whether or not the succeeding route portions thus obtained cross with the final route portions. When any succeeding route portion crosses with any final route portion, for example, at a point 15, as shown in FIG. 4, a completed operation route 5-6–15-11 or 5-7–15-11 is formed.

Such operations are iterated until the number f of the change-over operations of the pumps, that is, the number of the changing points of the route reaches a predetermined value f max. That is, the system will deal only with routes which have less than a predetermined number of change-over operations, so that, when all possible routes having less than the maximum number of changing points have been determined, the system stops its search for other routes. When the number f of the change-over operations of the pumps reaches a predetermined value f max, an evaluation function depending on, for example, the consumed power is calculated for each of the completed operation routes thus obtained. By the calculation results of the evaluation function, an optimum operation route is selected among the operation routes.

Figure 6:
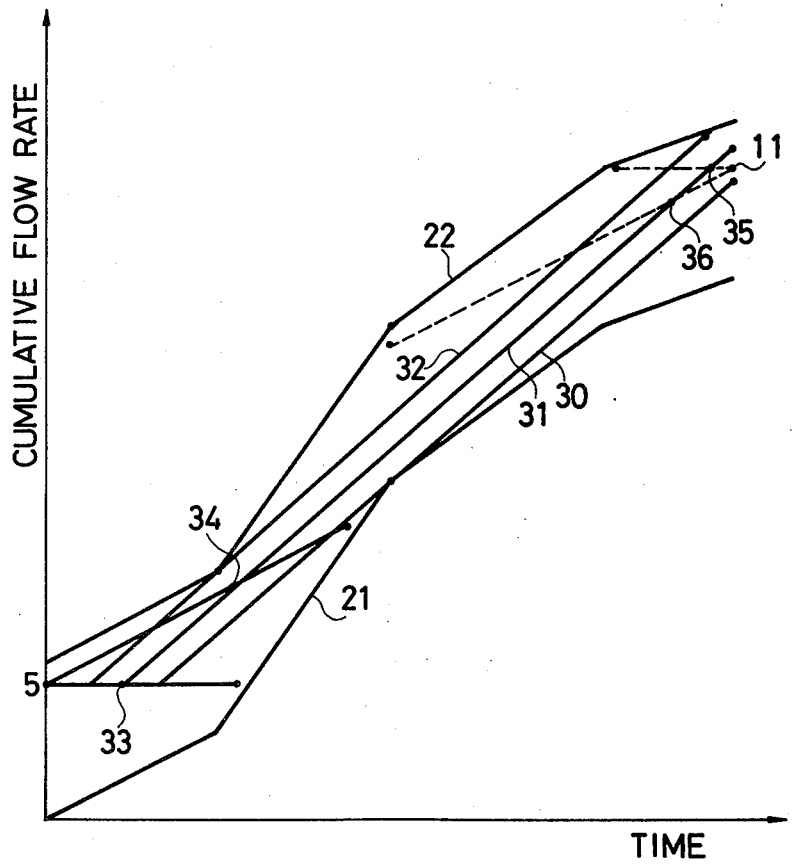
FIG. 6 is a diagram showing another example of pump operation routes according to the present invention.

In order to determine the operation routes in which the number of change-over operations of the pumps is smallest, it is possible to start intermediate route portion determination with the following process. That is, those intermediate route portions which have gradients provided by one of the available number of pumps to be operated and which also fall within the region between the lines 21 and 22 are first determined. The intermediate route portions are represented by, for example, direct lines 30, 31, and 32 as shown in FIG. 6. When these intermediate route portions cross the initial route portions and the final route portions, for example, when the route portion 31 crosses with the initial and final route portions at points 33, 34, 35, and 36 as shown in FIG. 6, completed operation routes, for example, routes 5-33–35-11 and 5-34–36-11, are obtained. When the intermediate route portions do not cross with the final route portions, the succeeding route portions started from the termination points of the intermediate route portions are determined as described above.

Furthermore, it is determined whether or not the succeeding route portions cross with the final route portions. These operations are iterated until the number of the change-over operations of the pumps reaches a predetermined value. The evaluation function corresponding to the completed operation routes thus obtained is also calculated.

The termination point of each of the route portions is obtained in the following manner. If it is presumed that the number of the pumps to be operated is n and the gradient of the route portion is qn, the route portion passing through a starting point (the x,y coordinate thereof is $x_A$, $Y_A$)) is represented by the following linear equations:

$$y=qn\,(x-x_A)+Y_A \quad (1)$$

$$x_A \leqq x \leqq x_B \quad (2)$$

In these equations, x and y correspond to the elasped time and the cumulative value of the flow rate, respectively, and $x_B$ represents a final time of the period for prediction.

On the other hand, each of the lines 21 and 22 is represented by the following equations in the respective periods during which each of the lines 21 and 22 is approximated by a direct line.

$$y=a_k x+b_k \quad (3)$$

$$x_{k-1} \leqq x \leqq x_k \quad (4)$$

In order to obtain the termination point of the route portion, the cross point at which the route portion represented by the equation (1) crosses with a line represented by the equation (3) and which is within the region shown in the equations (2) and (4) is determined. If there are a plurality of cross points at which lines represented by the equations (1) and (3) cross with each other and which satisfy the conditions of the equations (2) and (4), there is selected a cross point which has the minimum value for the x coordinate. The thus-obtained cross-point corresponds to the termination point of the route portion.

For example, in FIG. 4, route portions from a starting point 5 are terminated at termination points 6, 7, and 8 corresponding to the number of the operated pumps. The termination points correspond to the points of first change-over of the number of the operated pumps. Route portions starting from the points 6, 7, and 8 are terminated at the termination points 9, 10 and 10'. These points 9, 10, and 10' correspond to the points of second change-over of the operated pumps. These operations are iterated until the number of the change-over operations of the operated pumps reaches a predetermined value. On the other hand, the cross-points at which route portions started from the starting point 5 cross with the final route portions from the final target point 11 are determined. For example, cross points 15 to 18 are obtained by such search. Pump operation routes, for example, 5-6-5-11, 5-7-9-18-11, etc. are completed by the presence of these cross-points.

As the evaluation function, there is applied, for example, a function representing the consumed power. The power consumed by the pump operation due to each of the completed operation routes is calculated by means of the operation period and the number of the operated pumps in the respective change-over periods. Among these operation routes, is selected an optimum operation route realizing a minimum in power consumption.

Figure 7:
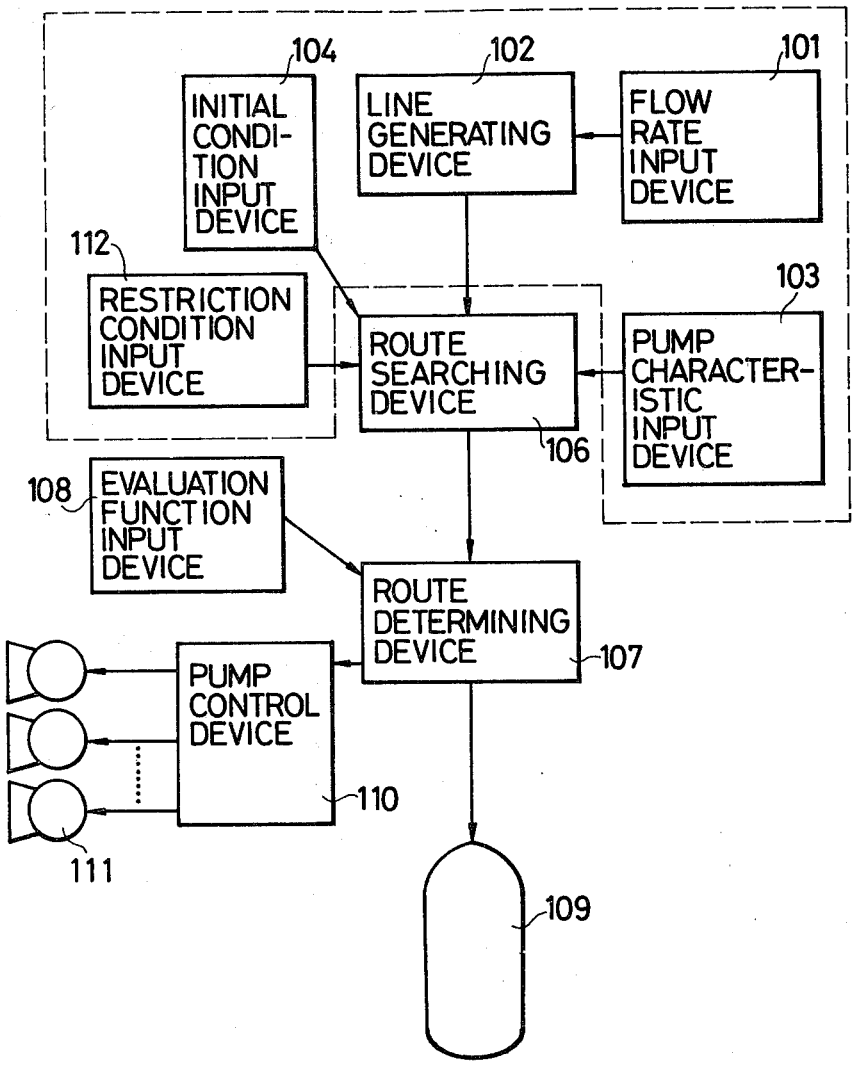
FIG. 7 is a schematic block diagram showing an embodiment of a device according to the present invention.

FIG. 7 shows an embodiment of a system for controlling the number of pumps to be operated according to the present invention. In FIG. 7, a flow rate input device 101 provides the predicted load flow rates during a predetermined period, a line generating device 102 generates characteristic lines, as shown at 21 and 22 of FIG. 4, under the predicted load flow rate from the device 101 and the capacity of the pond. A pump characteristic input device 103 provides the pumping-up flow rate corresponding to the number of pumps to be operated, an initial condition input device 104 provides the initial pondage, and a restriction condition input device 105 provides the target pondage at the final time and the maximum value of the number of the change-over operations. A condition input device 112 is formed by these devices 101 to 105.

The devices 101, 103, 104, and 105 merely provide the various conditions which determine the desired operation of the system. As such, they may comprise or include conventional pattern generators, voltage sources, or registers which generate or store the predicted load flow rate, pump characteristics, the initial pondage, the target pondage, and maximum number of change-over operations. The line generating device 102 may take the form of a conventional non-linear voltage generating device capable of operation in accordance with equations (1) and (2) to define the curved line representing the cumulative values of the predicted cumulative flow rates and the curved line representing the sum of the cumulative values and the capacity of the pond.

A route searching device 106 determines the completed operation routes in response to the conditions received from the condition input device 112, and a route determining device 107 calculates the value of an evaluation function from an evaluation function input device 108 corresponding to each of the completed operation routes received from the searching device 106 and for determining an optimum operation route having the optimum value of the evaluation function. A display device 109 is provided for displaying the output of the determining device 107, and a pump control device 110 controls the operation of pumps 111 in response to the output of the determining device 107.

With such a construction, the predicted load flow rates during a predetermined period are inputted from the input device 101 to the generating device 102. In this generating device, a curved line representing the cumulative values of the predicted load flow rates and a curved line representing the sum of the cumulative values and the capacity of the pond, such as shown at 21 and 22 of FIG. 4, are generated in response to information from the input device 101. The respective portions of each of these curved lines are represented by, for example, the equations (3) and (4). Various conditions are inputted from the condition input device 112 to the searching device 106.

In the searching device 106, route portions which are started from the initial point determined from the input device 104 and which have gradients corresponding to the pumping-up flow rate from the input device 103 are generated. Each of the route portions is represented by, for example, the equations (1) and (2). When the route portions cross with the lines generated by the generating device 102, they are terminated and the succeeding route portions which are started from the termination points are generated. When the thus-obtained route portions cross with the final route portions passing through the final target point corresponding to the target pondage, as determined from the input device 105, the operation routes are completed.

Until the number of the pump change-over from the input device 105 reaches a predetermined value, such operations are iterated. These completed operation routes are then supplied from the searching device 106 to the determining device 107. In the determining device 107, the values of the evaluation function from the input device 108 is calculated corresponding to each of the completed operation routes and an optimum operation route is selected under the calculation results of the evaluation function. Such an optimum operation route is displayed by the display device 109. At the same time, it is stored in the pump control device 110. Pumps 111 are thereafter controlled by the operation signal corresponding to the operation route.

Figure 8:
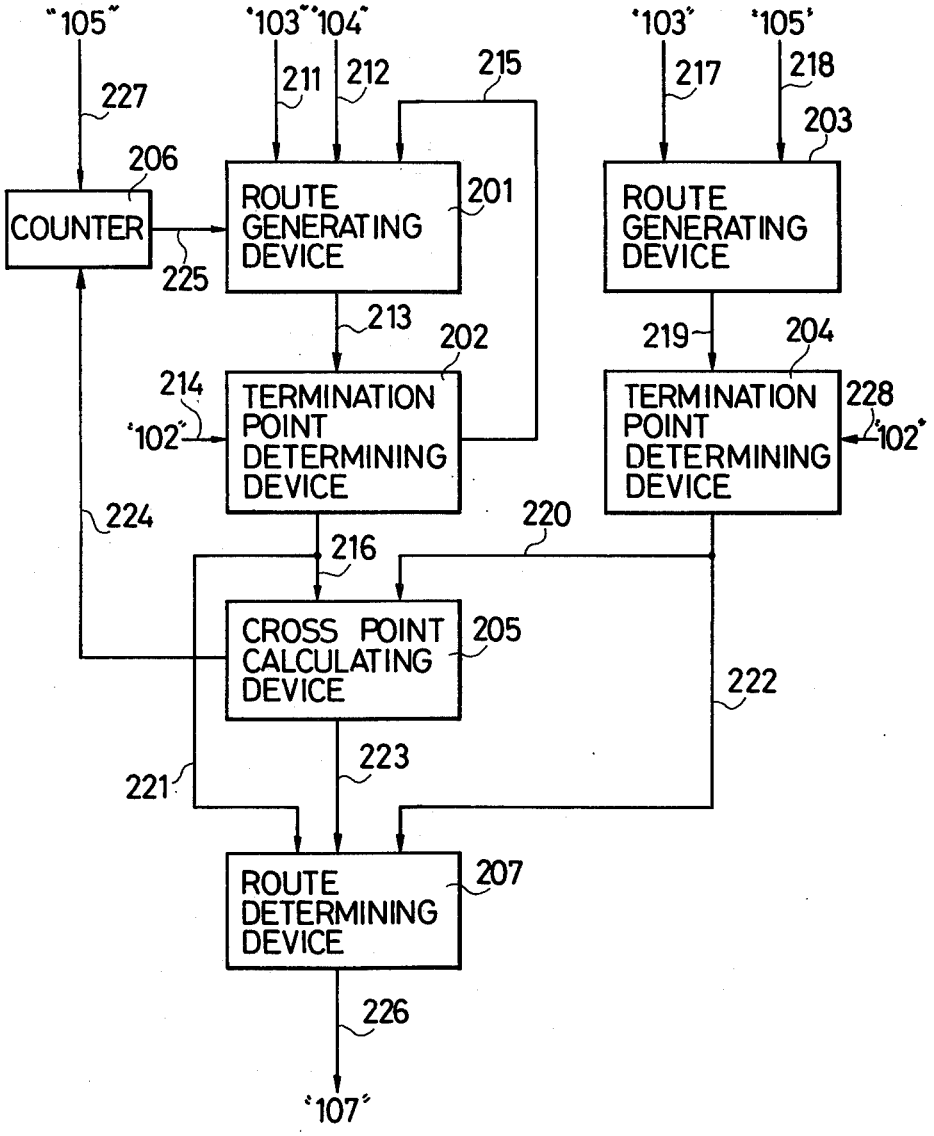
FIGS. 8 and 9 are schematic block diagrams showing examples of the construction of parts of the device shown in FIG. 7.

FIG. 8 shows an example of the construction of the route searching device 106 shown in FIG. 7. In FIG. 8, a route generating device 201 is provided for generating route portions which are started from the initial point and which have gradients corresponding to the number of operated pumps. A termination point determinating device 202 is provided for determining the termination points of the portion routes and a route generating device 203 generates the final route portions which pass through the final target point. A termination point determining device 204 is also provided for determining the termination points of the final route portions. A cross-point calculating device 205 determines the cross-points between the initial route portions determined from the device 202 and the final route portions determined from the device 204, and a route determining device 207 determines the completed operation routes. Numeral 206 identifies a counter for setting the maximum number of the pump change-over points and numerals 211 to 228 designate signal lines.

With such a construction, the pumping-up flow rate corresponding to the number of pumps to be operated is supplied from the input device 103 to the generating devices 201 and 203 through signal lines 211 and 217. The initial pondage is supplied from the input device 104 to the generating device 201 through the signal line 212. The final target pondage and the maximum number of the pump change-over operations are supplied from the input device 105 to the generating device 203 and the counter 206 through the signal lines 218 and 227, respectively. Furthermore, signals representing the curved characteristic lines are supplied from the generating device 102 to the determining devices 202 and 204 through the signal lines 214 and 228.

In the generating device 201, there are generated route portions which are started from the initial point corresponding to the initial pondage and which have gradients corresponding to the pumping-up flow rates. Each of the route portions is represented by the equations (1) and (2). The contents of the generated route portions are supplied through the signal line 213 to the determining device 202. In the determining device 202, the cross-points between the route portions from the generating device 201 and the curved lines from the generating device 102 are determined and these cross-points designate the termination points of the respective initial route portions.

The information representing termination points is supplied through the signal line 215 to the generating device 201. The information representing the route portions including the starting points and the termination points is supplied through the signal lines 216 and 221 to the calculating device 205 and the determining device 207. On the other hand, in the generating device 203, there are generated final route portions which pass through the final target point corresponding to the final target pondage and which have gradients corresponding to the pumping-up flow rates. The information representing the final route portions is supplied through the signal line 219 to the determining device 204.

In the device 204, the cross-points between the final route portions from the device 203 and the curved lines from the device 102 are determined and these cross-points represent the termination points of the respective final route portions. The information representing the final route portions including the final target points and the termination points is supplied through the signal lines 220 and 222 to the devices 205 and 207.

In the calculating device 205 the cross-points between the route portions from the device 202 and the final route portions from the device 204 are determined, and the information representing these cross-points is supplied through the signal line 223 to the determining device 207 and, at the same time, a signal from the device 205 is supplied through the signal line 224 to the counter 206. The contents of the counter 206 are decreased by one in response to the signal from the device 205. When the contents of the counter 206 become a zero, a signal from the counter 206 is supplied through the signal line 225 to the device 201. The operation of the device 201 is suspended by the signal from the counter 206.

Until the contents of the counter 206 become zero, the succeeding route portions which started from the termination points are successively generated in the device 201. That is, such operations are iterated until the number of the pump change-over operations reach the maximum value. In the determining device 207, the completed operation routes are obtained by the information from the devices 202, 204, and 205. The thus-obtained operation routes are supplied through the signal line 226 to the determining device 107, shown in FIG. 7.

Figure 9:
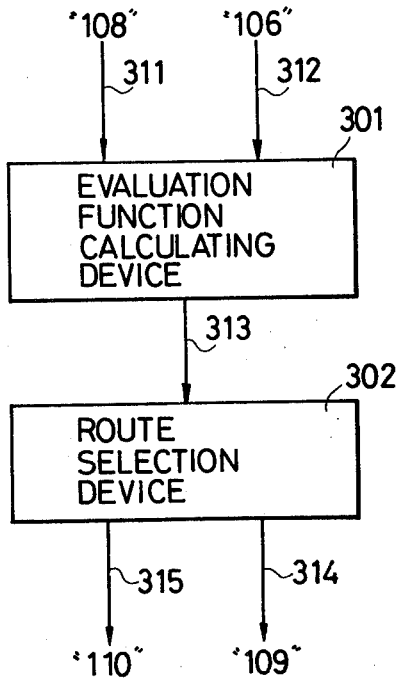

FIG. 9 shows an example of the construction of the determining device 107 of FIG. 7. In FIG. 9, numeral 301 designates a calculating device for calculating the values of the evaluation function corresponding to the respective operation routes and numeral 302 designates a selection device for selecting an optimum operation route which has the minimum value of the evaluation function. The numerals 311 to 315 designate signal lines.

The evaluation function and the completed operation routes are supplied from the device 108 and 106 to the calculating device 301 through the signal lines 311 and 312. In the calculating device 301, the value of the evaluation function is calculated for each of the operation routes. The thus-obtained values are supplied through the signal line 313 to the selection device 302. In the selection device 302, there is selected an optimum operation route in which the value of the evaluation function is a minimum value or at least most suitable. The optimum operation route is supplied through the signal lines 314 and 315 to the devices 109 and 110 shown in FIG. 7.

Such individual devices as shown in FIGS. 8 and 9 are well known and constructed by well-known components. Therefore, the details of the construction of these devices is not shown in the drawings.

According to the embodiment described above, the number of pumps to be operated is controlled in response to an optimum operation route with the minimum number of change-over operations of the pumps and with less energy consumption.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. A method for controlling the number of pumps to be operated in a multi-pump fluid supply system including a pond or reservoir comprising the steps of:

generating a first characteristic line relating to the cumulative values of predicted load flow rates with time and a second line relating to the sum of the cumulative values of predicted load flow rates and the capacity of the pond or reservoir with time;

plotting possible pump operation routes passing through the region between the first and second lines so that the gradient of the route portion of each pump operation route is changed when the route portion reaches one of the first and second lines, until the number of gradient changing points of said pump operation route reaches a predetermined value;

calculating the value of an evaluation function for every pump operation route which has been plotted;

selecting the optimum pump operation route having a most suitable evaluation function; and controlling the number of pumps to be operated in response to the selected optimum pump operation route.

2. A method according to claim 1, in which each of said first and second lines is approximated by a polygonal line.

3. A method according to claim 1, wherein said evaluation function comprises a determination of pump energy consumption for the system.

4. A method according to claim 1, in which said step of plotting operation routes includes a first step of determining possible final route portions passing through a final route point corresponding to the target pondage based upon available pump rates, a second step of determining initial route portions which start from an initial route point corresponding to the initial pondage based upon available pump rates and which are terminated when the initial route portions reach one of the first and second lines, a third step of determining intermediate route portions which start from the termination points of said initial route portions and which terminate at one of said first and second lines, a fourth step of detecting the cross-points between the intermediate route portions and the final route portions, and a fifth step of obtaining a completed pump operation route when such cross points are detected.

5. A method according to claim 1, in which said step of plotting operation routes includes a first step for determining possible final route portions passing through a final route point corresponding to the target pondage based upon available pump rates, a second step for determining initial route portions which are started from an initial route point corresponding to the initial pondage based upon available pump rates and which are terminated when the initial route portions reach one of the first and second lines, a third step for detecting the cross-points between the initial route portions and the final route portions, and a fourth step for obtaining the completed pump operation routes when the initial route portion crosses with a final route portion.

6. A method according to claim 5, in which said plotting step further includes a fifth step for searching intermediate route portions which pass through the region between the first and second lines and which have gradients corresponding to the gradients of an intermediate portion of the first and second lines.

7. A device for controlling the number of pumps to be operated in a multi-pump fluid supply system including a pond or reservoir comprising:

first means for generating a first electrical signal representing the characteristic line relating to the cumulative values of predicted load flow rates with time for the system and a second electrical signal representing the characteristic line relating to the sum of the cumulative values of predicted load flow rates and the capacity of the pond or reservoir with time;

second means for determining available pump operation routes passing through the region between the characteristic lines represented by said first and second signals received from said first means and in which the gradient of the route portion of each pump operation route is changed when the route portion reaches one of the characteristic lines;

third means for calculating the value of an evaluation function for every pump operation route determined by said second means;

fourth means for selecting an optimum pump operation route having the most suitable evaluation function in response to the calculation results of said third means; and fifth means for controlling the number of the pumps to be operated in response to the optimum pump operation route selected by said fourth means.

8. A device according to claim 7, wherein said evaluation function comprises a determination of pump energy consumption for the system.

9. A device according to claim 7, wherein said second means includes first route generating means for generating signals corresponding to final route portions passing through a final route point corresponding to the target pondage and having gradients based upon available pump rates, and first comparison means for comparing the signals generated by said first route generating means with said first and second signals to detect the termination points thereof.

10. A device according to claim 9 wherein said second means further includes second route generating means for generating signals corresponding to initial route portions passing through an initial route point corresponding to the initial pondage and having gradients based upon available pump rates, and second comparison means for comparing the signals generated by said second route generating means with said first and second signals to detect certain change-over points.

11. A device according to claim 10 wherein said second means further includes cross-point determining means for comparing said route portions to detect the cross-points therebetween, and route determining means responsive to said cross-point determining means for detecting completed operation routes.

12. A device for controlling the number of pumps to be operated in a multi-pump fluid supply system including a pond or reservoir comprising:

first means for generating a signal designating the predicted load flow rates in a predetermined period;

second means connected with said first means for generating a first signal representing a characteristic line relating to the cumulative values of the predicted load flow rates and a second signal representing a characteristic line relating to the sum of the cumulative values of the predicted load flow rates and the capacity of the pond or reservoir;

third means for generating a signal representing the initial pondage of the pond or reservoir;

fourth means for generating a signal representing the final target pondage;

fifth means for generating a signal representing the maximum number of pump change-over operations to be permitted within said predetermined period;

sixth means connected to said second, third, fourth, and fifth means for determining pump operation routes which are within the region between the characteristic lines represented by said first and second signals and in which the number of gradient changing points is less than the maximum number of the pump change-over operations so that each pump operation route passes through a start point corresponding to the initial pondage and a final point corresponding to the final target pondage and the gradient of the route portion of each pump operation route is changed when the route portion reaches one of the characteristic lines;

seventh means for generating a signal representing an evaluation function;

eighth means connected to said sixth and seventh means for calculating the value of the evaluation function for every pump operation route determined by said sixth means;

ninth means connected to said eighth means for selecting an optimum pump operation route in response to the operation of said eighth means; and tenth means connected with said ninth means for controlling the number of the pumps to be operated in response to the selected optimum pump operation route.

13. A device according to claim 12, which further includes eleventh means connected to said ninth means for displaying the contents of the optimum pump operation route provided by said eighth means.

14. A device according to claim 12, wherein said evaluation function comprises a determination of pump energy consumption for the system.

15. In a multi-pump fluid supply system including a pond or reservoir, pumps for supplying fluid to said pond or reservoir, input means for inputting signals representing control conditions for said pumps, processing means for obtaining the optimum pump operation route in response to the control conditions and control means for controlling the number of pumps to be operated in response to the optimum pump operation route, a method for operating the processing means comprising the steps of:

generating a first electrical signal representing the first characteristic line relating to the cumulative values of predicted load flow rates inputted by said input means and a second electrical signal representing the second characteristic line relating to the sum of the cumulative values of predicted load flow rates and the capacity of the pond or reservoir inputted by said input means;

plotting signals representing possible pump operation routes passing through the region between the first and second characteristic lines so that the gradient of the route portion of each pump operation route is changed when the route portion reaches one of the first and second characteristic lines, the number of gradient changing points of said pump operation route being within a predetermined value;

calculating the value of an evaluation function for every pump operation route which has been plotted; and selecting the optimum pump operation route having a most suitable evaluation function.

16. A method according to claim 15, in which each of said first and second lines is approximated by a polygonal line.

17. A method according to claim 15, wherein said evaluation function comprises a determination of pump energy consumption for the system.

18. A method according to claim 15, in which said step of plotting operation routes includes a first step of determining possible final route portions passing through a final route point corresponding to the target pondage based upon available pump rates, a second step of determining initial route portions which start from an initial route point corresponding to the initial pondage based upon available pump rates and which are terminated when the initial route portions reach one of the first and second lines, a third step of determining intermediate route portions which start from the termination points of said initial route portions and which terminate at one of said first and second lines, a fourth step of detecting the cross-points between the intermediate route portions and the final route portions, and a fifth step of obtaining a completed pump operation route when such cross-points are detected.

19. A method according to claim 15, in which said step of plotting operation routes includes a first step for determining possible final route portions passing through a final route point corresponding to the target pondage based upon available pump rates, a second step for determining initial route portions which are started from an initial route point corresponding to the initial pondage based upon available pump rates and which are terminated when the initial route portions reach one of the first and second lines, a third step for detecting the cross-points between the initial route portions and the final route portions, and a fourth step for obtaining the completed pump operation routes when the initial route portion crosses with a final route portion.

20. A method according to claim 19, in which said plotting step further includes a fifth step for searching intermediate route portions which pass through the region between the first and second lines and which have gradients corresponding to the gradients of an intermediate portion of the first and second lines.

* * * * *